US005937538A

United States Patent [19]

Joiner

[11] Patent Number: 5,937,538

[45] **Date of Patent: *Aug. 17, 1999**

[54] THROUGH AIR DRYER APPARATUS FOR DRYING WEBS

[75] Inventor: John R. Joiner, Vancouver, Wash.

[73] Assignee: Fort James Corporation, Richmond, Va.

[ * ] Notice: This patent is subject to a terminal disclaimer.

[21] Appl. No.: 08/819,820

[22] Filed: Mar. 18, 1997

Related U.S. Application Data

[63] Continuation-in-part of application No. 08/651,890, May 21, 1996, abandoned, and a continuation-in-part of application No. 08/707,798, Sep. 4, 1996, Pat. No. 5,722,180.

[51] Int. Cl.[6] ..... F26B 11/02

[52] U.S. Cl. ..... 34/122; 34/114; 34/115

[58] Field of Search ..... 34/114, 115, 117, 34/122, 123, 116, 120, 124

[56] References Cited

U.S. PATENT DOCUMENTS 5,416,979 5/1995 Joiner ..... 34/114
5,722,180 3/1998 Joiner ..... 34/115

*Primary Examiner*—Henry Bennett
*Assistant Examiner*—Pamela A. Wilson
*Attorney, Agent, or Firm*—Burns, Doane, Swecker & Mathis, L.L.P.

[57] ABSTRACT

Apparatus for drying a web and modifying the moisture profile of the web includes a housing within which is disposed a through air dryer roll supporting a web. A fan located at an end of the roll causes flow of air through the web while the web is on the roll and through openings in the roll into the interior of the roll. The air then flows through a roll end and into the interior of the housing externally of the roll for recirculation back into the roll interior through the web and through the openings in the roll. Heaters heat the flowing air and are used to modify the moisture profile of the web. The apparatus is very compact.

20 Claims, 7 Drawing Sheets

THROUGH AIR DRYER APPARATUS FOR DRYING WEBS

This application is a continuation-in-part of U.S. patent application Ser. No. 08/651,890, filed May 21, 1996, now abandoned, and a continuation-in-part of U.S. patent application Ser. No. 08/707,798, filed Sep. 4, 1996, now U.S. Pat. No. 5,722,180.

TECHNICAL FIELD

This invention relates to an apparatus for drying a wet web. The apparatus is particularly applicable for through air drying a wet paper web during manufacture thereof.

BACKGROUND OF THE INVENTION

Through air dryers are well known expedients for drying wet paper webs, particularly tissue webs, conventionally employing a through air dryer roll for supporting and transporting the wet paper web and a through air dryer hood cooperable with the through air dryer roll to cause the passage of hot air through the through air dryer roll and the wet paper web thereon to dry the wet paper web.

Through air dryers employed in paper manufacture suffer from a number of deficiencies. Such arrangements typically employ bulky duct work. This results in high capital costs, fan pressure loss and the requirement that a considerable amount of physical space must be utilized. Conventional through air dryer fans are themselves bulky and difficult to locate close to paper machines.

The apparatus disclosed in above-noted co-pending U.S. patent application Ser. No. 08/707,798 eliminates the requirement for a bulky off machine fan and duct runs are either eliminated altogether or drastically reduced. When employing the apparatus there is less pressure across the seal between the rotating roll and stationary duct work as compared to prior art arrangements.

The apparatus of U.S. patent application Ser. No. 08/707,798, which is applicable for drying paper webs and other types of webs, includes a through air dryer roll for supporting a wet web while the wet web is being dried. The through air dryer roll has a double-ended cylindrical through air dryer roll wall with openings therein and defines a through air dryer roll interior communicating with the exterior of the through air dryer roll through the openings.

Through air dryer roll rotating means is provided for rotating the through air dryer roll.

A rotatable fan member having fan blades is located within the through air dryer roll interior and accommodated by an end of the through air dryer roll.

Fan member rotating means is provided for rotating the fan member within the through air dryer roll interior during rotation of the through air dryer roll by the through air dryer roll rotating means.

Air flow passageway defining means defines an air flow passageway between the fan member and the exterior of the through air dryer roll. The fan member upon rotation thereof by the fan member rotating means causes air flow through a web on the through air dryer roll through the openings of said through air dryer roll into the through air dryer roll interior, through the end of the through air dryer roll accommodating the fan member, and through the air flow passageway to the exterior of the through air dryer roll.

The air flow passageway defining means includes plenum defining means cooperable with the through air dryer roll to form a plenum located at the end of the through air dryer roll accommodating the fan member for receiving flowing air from the rotating fan member.

U.S. Pat. No. 5,416,979, issued May 23, 1995, discloses apparatus for drying a wet paper web during manufacture of the paper web. The apparatus allows the moisture profile of the web to be carefully controlled and adjusted. The apparatus includes a rotatable yankee dryer drum and a hood partially encompassing the rotatable dryer drum. A plurality of elongated heater nozzle boxes are disposed in the hood interior and extend across the dryer drum in the cross-machine direction, the elongated heater nozzle boxes being arrayed side-by-side in the machine direction. A plurality of gas burners is located in each of the nozzle box interiors and arranged side-by-side along the length of the nozzle box interiors for producing hot combustion gases within the nozzle box interiors of the heater nozzle boxes.

U.S. Pat. No. 5,425,852, issued Jun. 20, 1995, discloses a system for reducing blistering of a wet paper web on a yankee dryer. Blistering is controlled by directing compressed dry air toward the wet paper web in the space between a pressure roll external of the yankee dryer hood and the entry opening between the dryer hood and the yankee dryer drum. The flow of compressed air is controlled so that air flow can be modified across the full width of the wet paper web.

U.S. Pat. No. 5,465,504, issued Nov. 14, 1995, discloses drying a paper web on a yankee dryer. The moisture profile is controlled by arraying a plurality of gas burners in a cross-machine direction within the yankee dryer hood to direct heat toward incremental width portions of the paper web.

The invention disclosed in above-noted co-pending U.S. patent application Ser. No. 08/651,890 relates to drying a wet web and modifying the moisture profile thereof. In the embodiment disclosed in this latter application, the invention is employed to modify the moisture profile of a wet paper web while the paper web is being manufactured in a system utilizing a through air dryer; however, the principles of the invention are applicable to drying other types of webs. As noted above, through air dryers are well known expedients for drying wet paper webs, particularly tissue webs, conventionally employing a through air dryer roll for supporting and transporting the wet paper web and a through air dryer hood cooperable with the through air dryer roll to cause the passage of hot air through the through air dryer roll and the wet paper web thereon to dry the wet paper web. Flat bed through air dryers not employing a through air dryer roll and instead employing other forms of web support structure are also known.

Through air dryers are shown, for example, in the following United States patents: U.S. Pat. No. 3,303,576, issued Feb. 14, 1967, U.S. Pat. No. 3,432,936, issued Mar. 18, 1969, and U.S. Pat. No. 3,821,068, issued Jun. 28, 1974.

It is, of course, highly desirable to maintain a uniform moisture profile in a paper web during manufacture thereof in order to attain a high quality end product of uniform character. Conventional through air dryer systems present major problems with respect to obtaining and maintaining web uniform moisture profiles.

The problem is that through air dryers rely upon the passage of heated air through the wet paper web to accomplish drying. Any differences in the moisture profile of the wet paper web are actually amplified during the through drying process since web permeability is higher in the drier areas of the web and these areas will tend to dry faster than the wetter, less permeable portions of the web. In other words, the drier portions of the web tend to get even drier relative to the wetter portions. In order to overcome this problem it has been the practice in the prior art to "over dry" the entire web in order to obtain a degree of uniform dryness. This, of course, is highly wasteful of energy.

Conventional through air dryer arrangements have other drawbacks as well. Typically, conventional through air dryers require large volume combustion and air mixing chambers aimed at uniformly distributing heat. These arrangements take up considerable physical space and are capital intensive. Through air dryers conventionally employ structures within the hood interior, such as turning vanes, which are for the purpose of receiving heated air from a separate combustion chamber and distributing it uniformly prior to engagement with the wet paper web being dried in an attempt to maintain a uniform moisture profile. These mechanisms are not only complicated and expensive but are not as effective as desired from the stand point of maintaining a level moisture profile. Fan pressure loss and requirement for bulky and extensive duct work are additional problems in the prior art.

The invention of U.S. patent application Ser. No. 08/651,890 relates to an apparatus and to a method which are highly effective in controlling the moisture profile of a wet web being through air dried. The invention, as disclosed in such application, is employed to dry a wet paper web; however, the principles of the invention are applicable to dry other types of webs. The invention allows the elimination of the large combustion and air mixing chambers typically employed in prior art through air dry arrangements. Consequently, the apparatus constructed in accordance with the teachings of the invention occupies less physical space and requires a lower capital expenditure than typical prior art systems. Fan pressure loss commonly associated with prior art arrangements is minimized. Temperature and air flow distribution in the through air drier hood interior is less critical with the arrangement of the invention under discussion as compared to prior art arrangements because a profiling burner incorporated in the apparatus can readily compensate for variations. A considerable improvement in product quality results due to the fact that the apparatus and method of the invention provide a readily attained level moisture profile and the product need not be over dried.

The burner is much closer to the web when it is located in the hood than conventional. The volume of heated air between the burner and the web is small compared to conventional. This allows the hot supply air to cool down faster in the event the web is interrupted. This is important in tissue applications because the wet web protects a supporting fabric which cannot tolerate the hot supply air temperature.

The apparatus disclosed in U.S. patent application Ser. No. 08/651,890 is for the purpose of drying a wet web, such as a wet paper web, and modifying the moisture profile of the wet web. The apparatus includes a through air dryer hood defining a hood interior and at least one air supply inlet communicating with the hood interior.

A through air dryer support, such as a through air dryer roll, is mounted for movement relative to the through air dryer hood, the through air dryer web support for engaging a wet web as the web moves in a machine direction in communication with the hood interior.

Heater means is located within the hood interior for heating air within the hood interior during movement of the air from the air supply inlet to the through air dryer web support for drying the wet web.

The heater means comprises a plurality of gas burners located within the hood interior. The gas burners are disposed alongside one another in the cross-machine direction with each gas burner extending only part way along the length of the through air dryer support.

The apparatus additionally comprises air flow separator means located between the gas burners and the through air dryer roll for dividing air flowing through the hood interior between the gas burners and the through air dryer support into separate air flow portions. Each of the air flow portions is directed toward an incremental width portion of the wet web engaging the through air dryer web support.

In addition to the patents noted above, the following United States patents are considered representative of the current state of the prior art: U.S. Pat. No. 5,397,437, issued Mar. 14, 1995, U.S. Pat. No. 5,174,046, issued Dec. 29, 1992, U.S. Pat. No. 5,150,535, issued Sep. 29, 1992, U.S. Pat. No. 4,654,981, issued Apr. 7, 1987, U.S. Pat. No. 4,462,868, issued Jul. 31, 1984, U.S. Pat. No. 3,919,783, issued Nov. 18, 1975, U.S. Pat. No. 3,891,500, issued Jun. 24, 1975, U.S. Pat. No. 3,541,697, issued Nov. 24, 1970, and U.S. Pat. No. 3,340,617, issued Sep. 12, 1967.

DISCLOSURE OF INVENTION

The apparatus of the present invention is for drying a web and modifying the moisture profile of the web. The invention has the attributes and merits of the inventions disclosed in the two co-pending U.S. Patent applications identified and discussed above and of which the present application is a continuation-in-part. The apparatus of the present invention is very compact.

The apparatus of the present invention includes a housing defining a housing interior.

A through air dryer roll is mounted for rotational movement relative to said housing for supporting a web while the web is being dried and moving in a machine direction, said through air dryer roll having a double-ended cylindrical through air dryer roll wall defining openings and further defining a through air dryer roll interior communicating with the housing interior through said openings.

A rotatable fan member having fan blades is located within said through air dryer roll interior and accommodated by an end of said through air dryer roll. Fan member rotating means is provided for rotating said fan member relative to said through air dryer roll within said through air dryer roll interior during rotation of said through air dryer roll.

Air flow passageway defining means defines an air flow passageway between said fan member and the exterior of said through air dryer roll, said fan member upon rotation thereof by said fan member rotating means causing flow of air through a web on the through air dryer roll, through the openings of said through air dryer roll wall into the through air dryer roll interior, through the end of said through air dryer roll accommodating said fan member and into said housing interior for recirculation of the air back into said through air dryer roll interior through the web and through the openings of said through air dryer roll wall.

Heater means is disposed in said housing interior for heating the recirculating air within the housing interior prior to passage thereof through the web and through the openings of the through air dryer roll into the through air dryer roll interior.

Other features, advantages, and objects of the present invention will become apparent with reference to the following description and accompanying drawings.

BEST MODE FOR CARRYING OUT THE INVENTION

Figure 1:
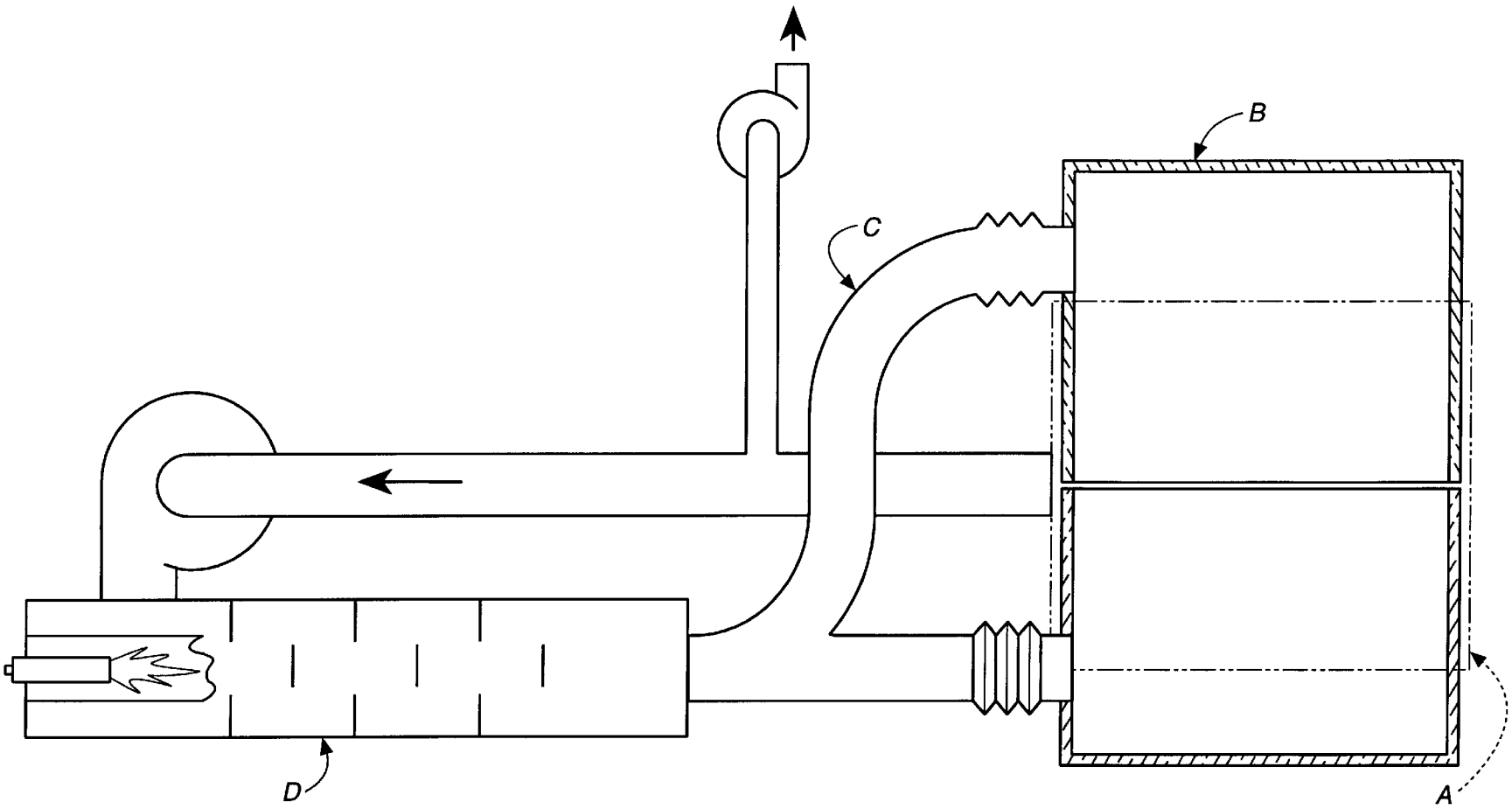
FIG. 1 (PRIOR ART)
FIG. 1 is a simplified schematic diagram illustrating the principle of operation of a typical prior art through air dryer for drying wet paper webs.

FIG. 1 is a highly simplified depiction of a typical prior art through air dryer approach. A through air dryer roll A is rotatably disposed in communication with the interior of a through air dryer hood B. Duct work C having articulated joints delivers hot air to and from the hood and roll to cause movement of dryer air through the roll. A separate combustion chamber D heats the air before it is recirculated back to the through air dryer per se. Air mixing devices are conventionally incorporated in the combustion chamber. Such arrangements are massive and have difficulty uniformly drying the wet paper web. Turning vanes or other stationary devices (not shown) are often employed in the hood, adding to the mass and complexity of the system without properly solving the problem of nonuniform moisture profile in a satisfactory manner.

Referring now to the other Figures of the drawing, apparatus constructed in accordance with the teachings of the present invention is illustrated. The disclosed apparatus is for the purposes of drying a wet web such as wet paper web W (shown in FIGS. 3 and 5) and includes a through air dryer roll 10 for supporting the web while it is being dried.

Through air dryer roll 10 has a double-ended cylindrical through air dryer roll wall 12 having a plurality of openings therein. The through air dryer roll wall defines a through air dryer roll interior 14 communicating with the exterior of the through air dryer roll through the openings. The through air dryer roll construction just described is conventional.

The roll 10 is rotatably mounted within the interior of a housing or hood 15 which may include conventional dry end and wet end hood sections which can retract or move relative to the roll by suitable mechanism (not shown) to allow access by persons performing such tasks as repair and maintenance.

A roll journal 16 supports the through air dryer roll 10 at one end thereof, the roll journal itself being rotatably supported by a bearing and bracket 18. Bearings inside roll journal 16 accommodate a stationary inner journal connected to an end plate affixed to stationary perforated air distribution plate 80, the latter being described in greater detail below. The other end of the through air dryer roll has an elongated support journal or spindle 20 projecting from a roll end wall 22. Support spindle 20 is hollow, defining a throughbore communicating with the interior 14 of the through air dryer roll.

Support spindle 20 projects into a gear box 26. A motor 28 drives the gears (not shown) in gear box 26 to rotate support spindle 20 and through air dryer roll 10.

Projecting from the output shaft of another motor 30 is a rotatable drive shaft 32 which extends through a fixed journal in the form of hollow tubular member 62 within support spindle 20, separated therefrom by bearings, and connected to an end wall or plate affixed to stationary air distribution plate 80. A torque arm (not shown) prevents member 62, plate 80 and other stationary roll internals from rotating. Bearings inside hollow tubular member 62 support fan shaft 40 which is driven by motor 30 through drive shaft 32. The distal end 40 of the drive shaft projects into the interior of the through air dryer roll 10.

Figure 2:
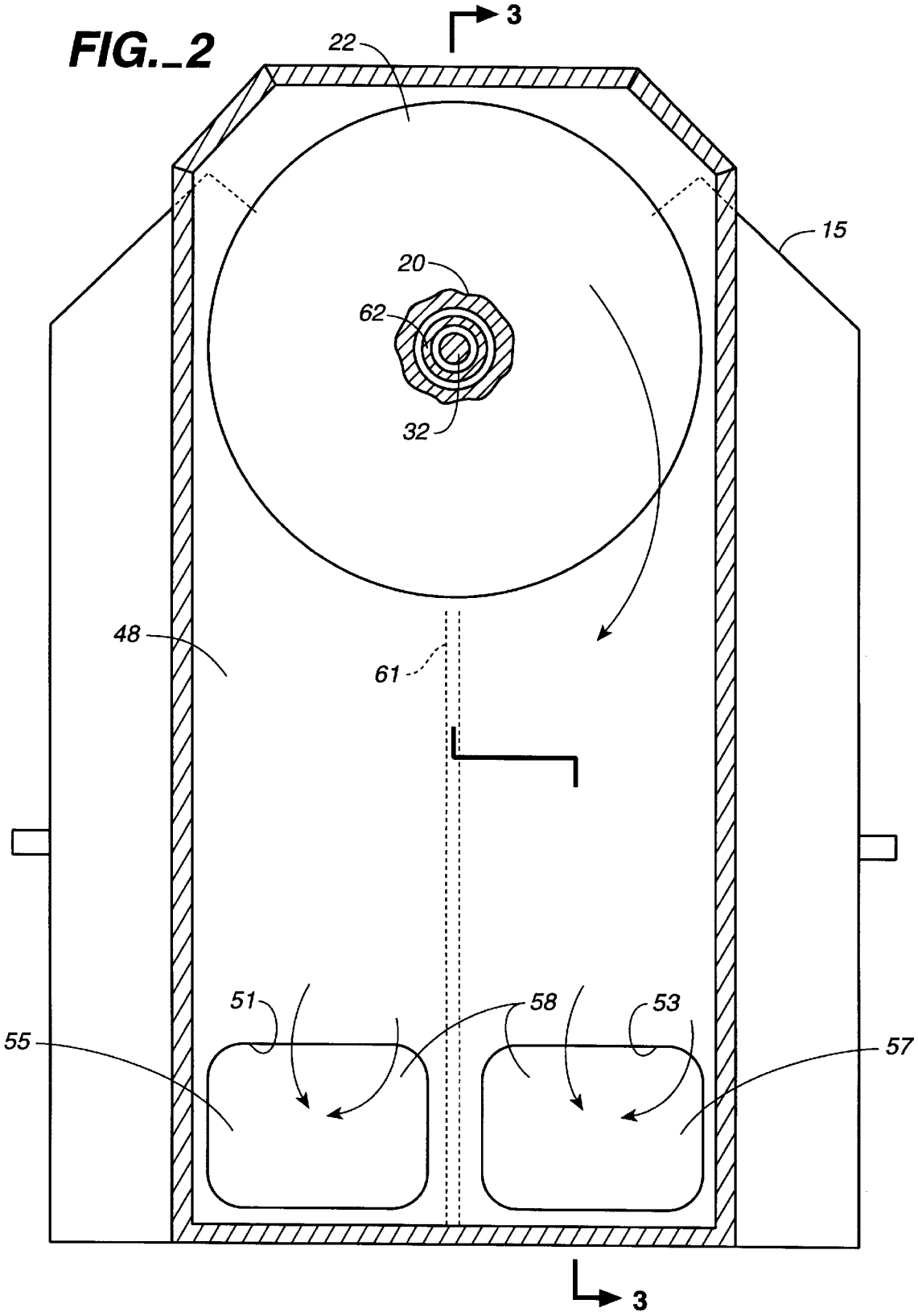
FIG. 2 is a somewhat simplified, diagrammatic, cross-sectional view of selected components of apparatus constructed in accordance with the teachings of the present invention as taken along the line 2—2 in FIG. 3.

Attached to drive shaft distal end 40 is a rotatable fan member 42 having a plurality of blades 44. In the arrangement illustrated, the fan member 42 is a centrifugal fan wheel. Leading away from the fan wheel is a scroll 46 which directs the air generated by rotating fan member 42 to a plenum 48 as shown by the arrows in FIGS. 2 and 3. Plenum 48 leads to openings 51, 53 which in turn lead to separate portions 55, 57, respectively, of heating chamber 58 of housing 15 separated by divider walls 61.

Plenum 48 is defined by a primary plenum wall 50 spaced from roll end wall 52 and a plenum side wall 54 which extends about and is closely adjacent to the through dryer roll wall 12 at the end of the roll accommodating fan member 42. The web W supported by the through air dryer roll 10 does not extend over that portion of the through air dryer roll encompassed by plenum side wall 54. An adjustable vent 59 controls exhaust air flow.

One side of the scroll 46 is defined by a partition 60 positioned within the through air dryer roll interior adjacent to the fan member 42. Partition 60 is supported along with the rest of the scroll structure by a hollow tubular member 62 which is fixed against rotatable and axial movement. In other words, the tubular member 62 and structure including partition 60 supported thereby are immobile.

The partition 60 divides the through air dryer roll interior into a first interior section 64 within which fan member 42 is positioned and a second interior section 66.

Partition 60 includes a fan inlet bell 68 defining a partition opening 70. Opening 70 is centered with respect to the rotational axis of fan member 42. The distal end of the fan inlet bell curves inwardly toward the fan and is closely adjacent to the blades 44.

The immobile partition 60 has a circular outer periphery terminating closely adjacent to the through air dryer roll wall 12 and a circumferentially extending seal 72 minimizes airflow between the partition and the through air dryer roll wall.

Figure 5:
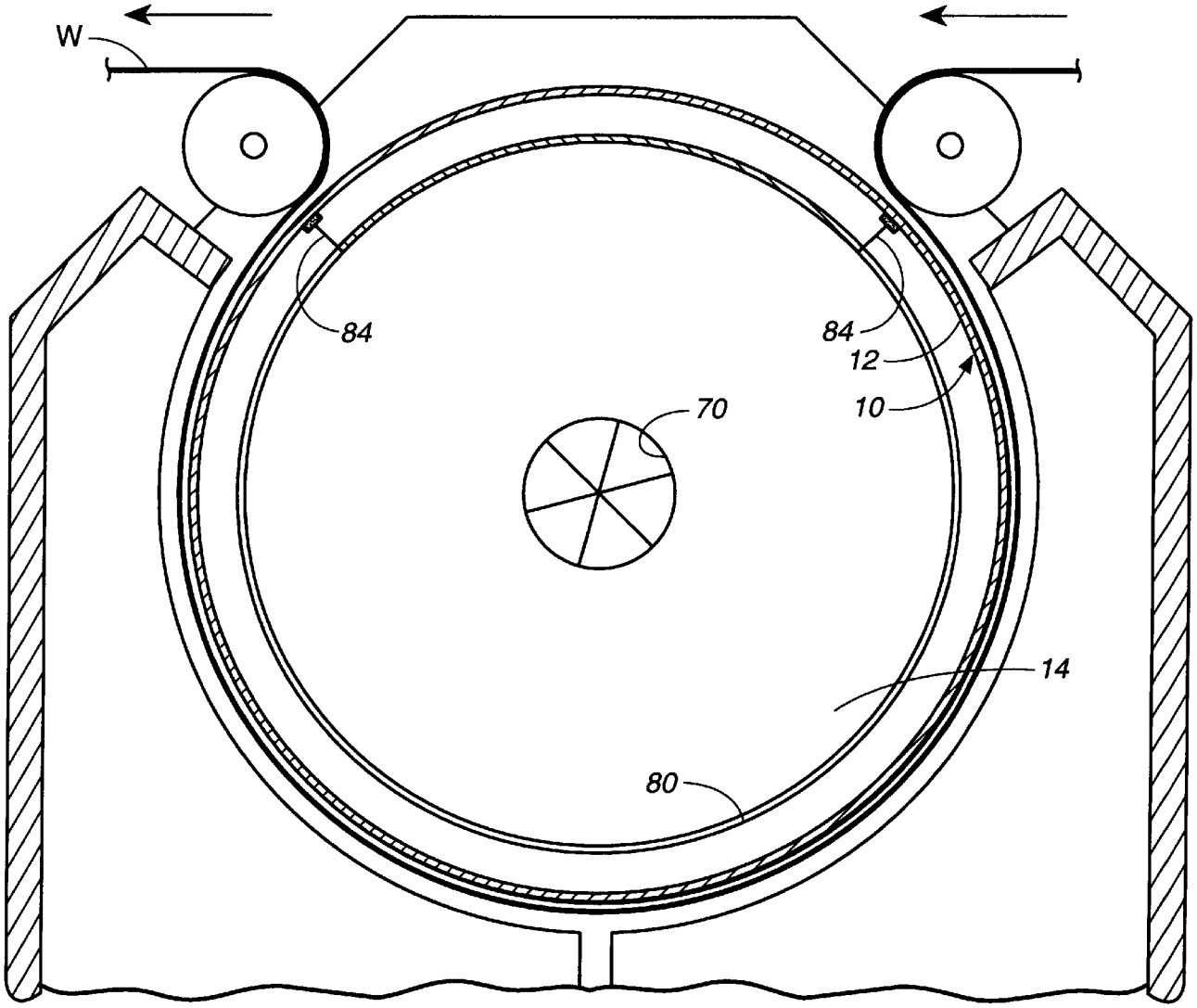
FIG. 5 is a partial cross-sectional view taken along the line 5—5 in FIG. 3.

That portion of the through air dryer roll 10 which corresponds to the second interior section thereof is positioned within the housing interior and the web W is within the confines of the hood or housing as it is transferred therethrough by the through air dryer roll 10. With reference to FIG. 5, a pair of rolls are illustrated to apply the web to the through air dryer roll and remove the web therefrom;

however, use of rolls is not required when practicing the teachings of this invention.

Cylindrically-shaped air distribution plate 80 extends from partition 60 into the second interior section 66 of the through air dryer roll. The air distribution plate is immobile and spaced inwardly of the cylindrical through air dryer roll. The end of the distribution plate 80 at the end of the through air dryer roll not accommodating fan member 42 is closely adjacent to end wall 82 of the through air dryer wall. As stated above, the air distribution plate is supported by journals extending from affixed end plates or walls.

Most of the air distribution plate defines a plurality of openings allowing air flow therethrough. This air flow segment is the area bounded by and extending downwardly from two seal elements 84 (FIG. 5) providing a substantially airtight seal between the air distribution plate 80 and the through air dryer roll wall.

The top segment or portion of the air distribution plate (as seen in FIG. 5) between the seal elements 84 is solid so that air cannot readily flow through the distribution plate in such area nor through the through dryer roll except where the paper web being dried is engaged by the roll. The edges of the web are also sealed.

Although the disclosed embodiment illustrates a rotating fan at only one end of the through air dryer roll, it will be appreciated that such structure could be employed at both ends. The fans could be independently driven or interconnected to be driven simultaneously by a common prime mover. If desired, roll support 18 could be suspended from above to facilitate installation of an endless web support fabric as is common practice with tissue.

Figure 3:
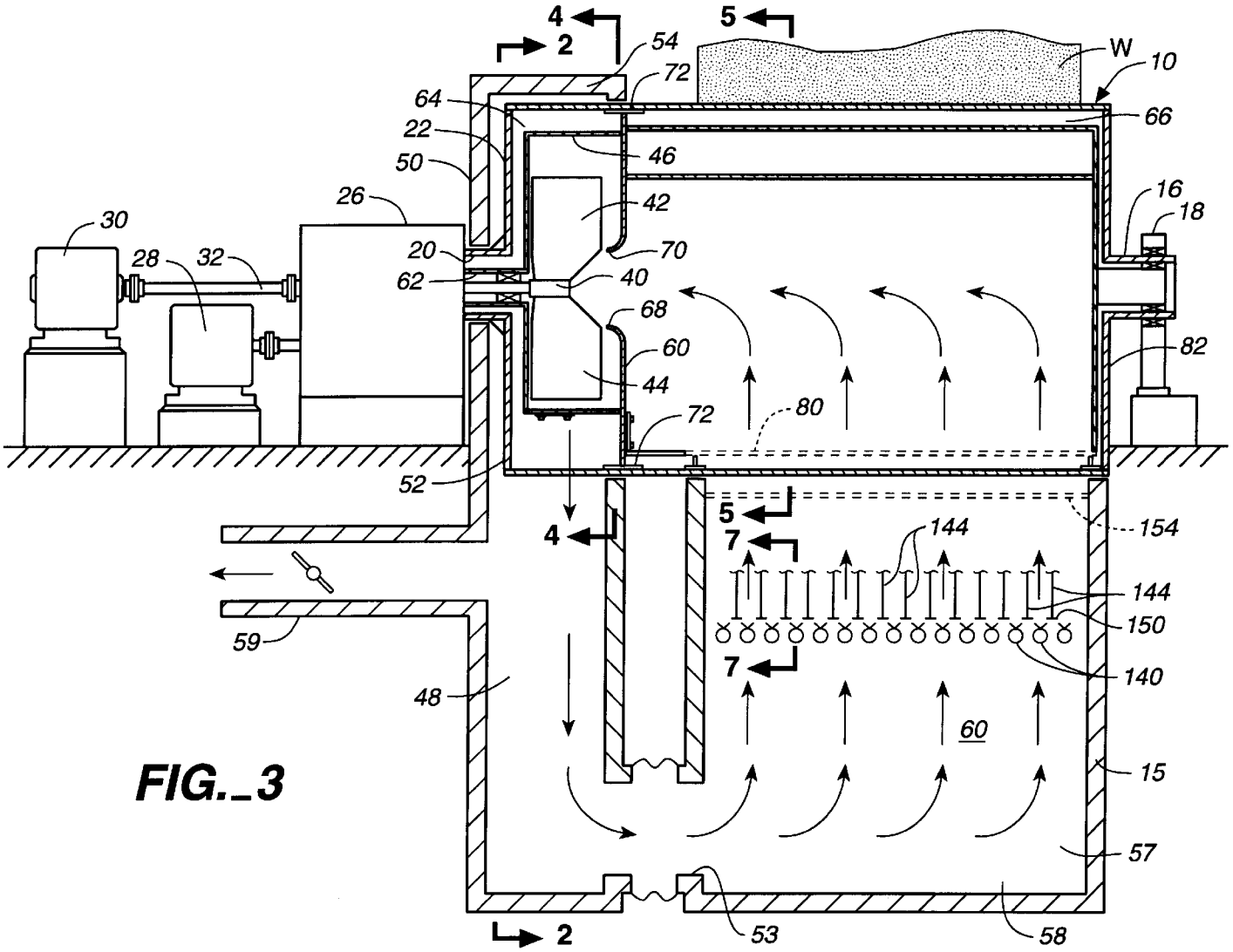
FIG. 3 is a cross-sectional diagrammatic view taken along the line 3—3 in FIG. 2.
Figure 4:
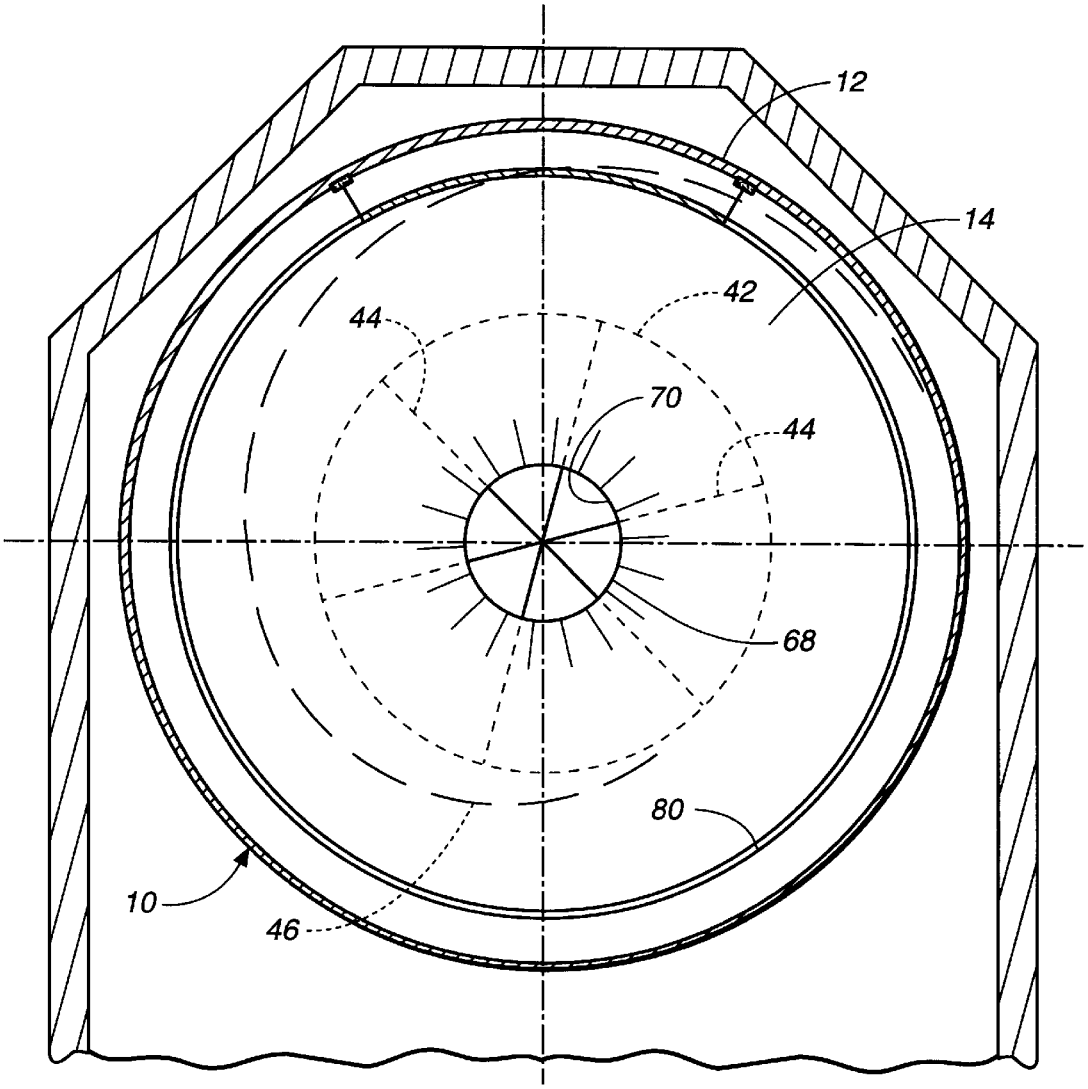
FIG. 4 is a somewhat diagrammatic, enlarged, partial cross-sectional side view of the apparatus constructed in accordance with the teachings of the present invention drying a moving wet paper web as taken along the line 4—4 in FIG. 3.

Located in each of the heating chamber portions 55, 57 of the housing are a plurality of gas burners or nozzles 140 which are elongated and disposed alongside one another in the cross-machine direction. In the interest of simplicity, FIG. 3 depicts only the burners in heating chamber portion 57. Each gas burner extends only part way along the length of the through air dryer roll. A flame shield 142 in the form of two diverging shield walls extends upwardly from each of the gas burners to protect the flame from the cooler supply air until the combustion process is complete.

Located between adjacent gas burners or nozzles 140 and having lower edges disposed a distance above the burners are partitions or plates 144 which define a plurality of heated air flow channels 146 substantially centered over the burners. The partitions 144 serve to divide air flowing through the hood interior between the gas burners and the through air dryer roll into separate air flow portions, each of the air flow portions being directed toward an incremental width portion of the wet paper web engaging the through air dryer roll outer cylindrical wall.

It will be appreciated that each air flow portion is heated by a particular burner as air moves from the plenum 48 to the through air dryer roll. By adjusting the heat applied to the air flow portions by their respective gas burners, a varied heat profile may be applied to the wet paper web, thus modifying the moisture profile of the wet paper web.

Disposed above the gas burners 140 is mixing means for mixing and creating turbulence in each of the air flow portions prior to engagement thereof with the wet paper web. The mixing means comprises a plurality of mixing elements in the form of a plurality of spaced, flat bars 150 in the heated flow channels which are impacted by the air flowing through the hood interior. These mixing bars promote heat distribution uniformity with respect to each of the air flow portions.

The numbers of gas burners or nozzles employed will, of course, depend upon such factors as the size of the through air dryer roll and the size of the width portion of the wet paper web to be impacted by a particular air flow portion. Six inches, for example, is a representative air flow channel width.

The apparatus incorporates yet other structure for distributing air flow to the wet paper web on the through air dryer roll. In particular, the apparatus includes a perforated plate 154 which curves about and generally conforms to the shape of the through air dryer roll cylindrical wall.

Each of the gas burners or nozzles 140 receive a mixture of a combustible gas such as natural gas and air to fuel the burner flame. The gas burners are controlled so that the flowing air portions heated thereby are heated to the desired extent as necessary to provide an even moisture profile in the wet paper web; that is, the wetter segments of the web will have more heat applied to them than do the drier segments.

Figure 8:
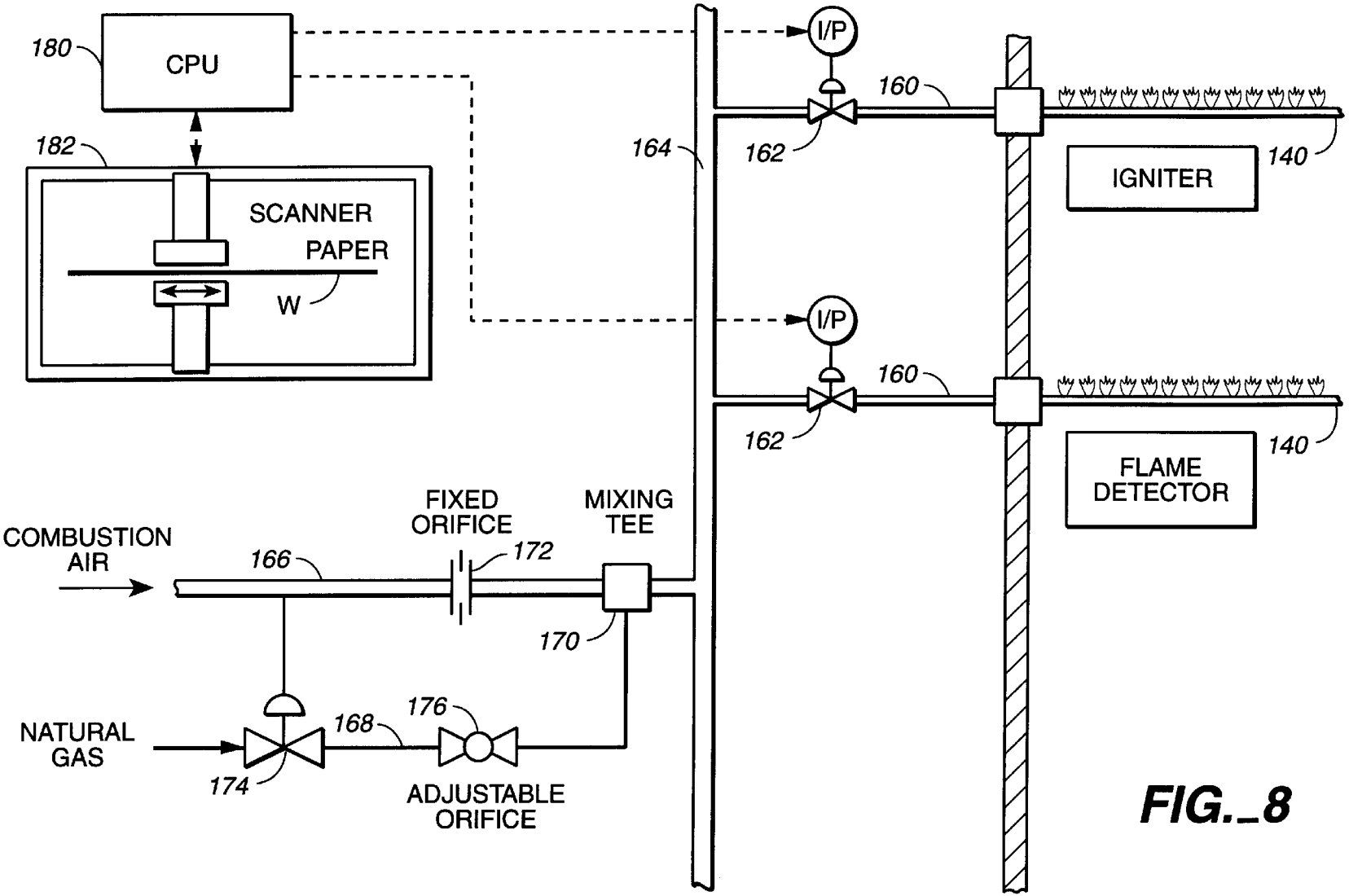
FIG. 8 is a schematic plan view illustrating control means for controlling operation of gas burners of the apparatus.

FIG. 8 illustrates one approach for regulating the heat applied to the gas burners. In this arrangement each gas burner is fed by a supply line 160 having a control valve 162 operatively associated therewith. A header 164 is in flow communication with supply lines 160 and delivers a combination of natural gas and combustion air thereto, the combustion air being delivered through an air supply pipe 166 and the natural gas being delivered by a gas supply pipe 168. Supply pipes 166, 168 join at a mixing tee 170.

In the arrangement shown in FIG. 8, a fixed orifice 172 is located in air supply pipe 166. A control valve 174 is disposed in gas supply pipe 168 and operation thereof is controlled as a function of the air flow in air supply pipe 166 to maintain a desired ratio between the air and the natural gas. An adjustable orifice 176 is disposed in gas supply line 168.

A suitably programmed central processing unit 180 of any known commercial type controls control valves 162 to vary the heat of the various gas burners in accordance with the moisture profile sensed in moving web W. Any suitable known commercially available scanning moisture gauge 182 can be employed for such purpose, the scanning moisture gauge sending appropriate signals to the CPU 180. Preferably, the moisture profile of the wet paper web is sensed at a location just down stream from the through air dryer so that the gas burners may be adjusted appropriately.

Figure 6:
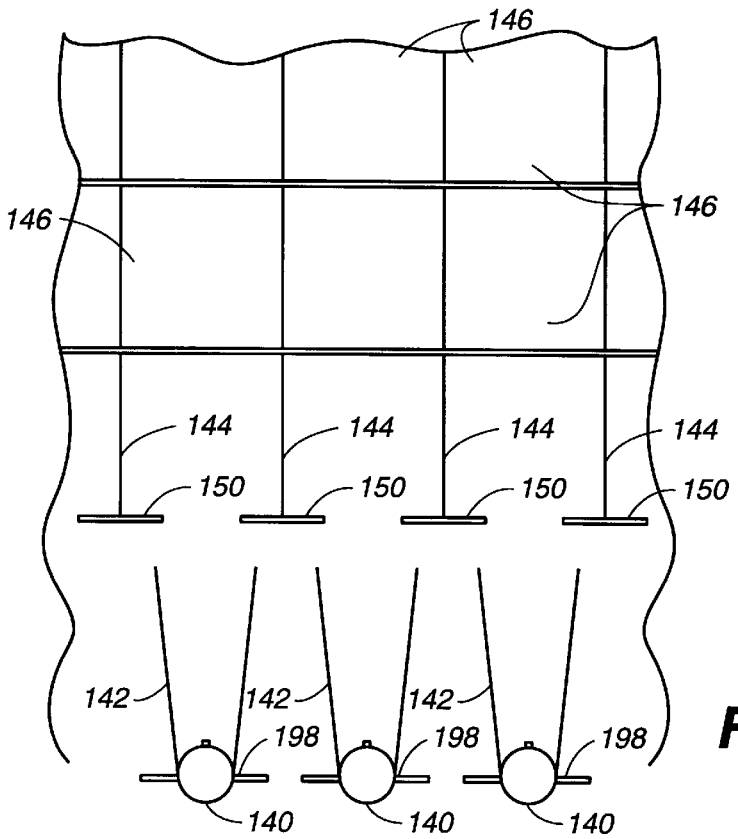
FIG. 6 is a diagrammatic enlarged view depicting several gas burners of the apparatus and selected associated structure.
Figure 7:
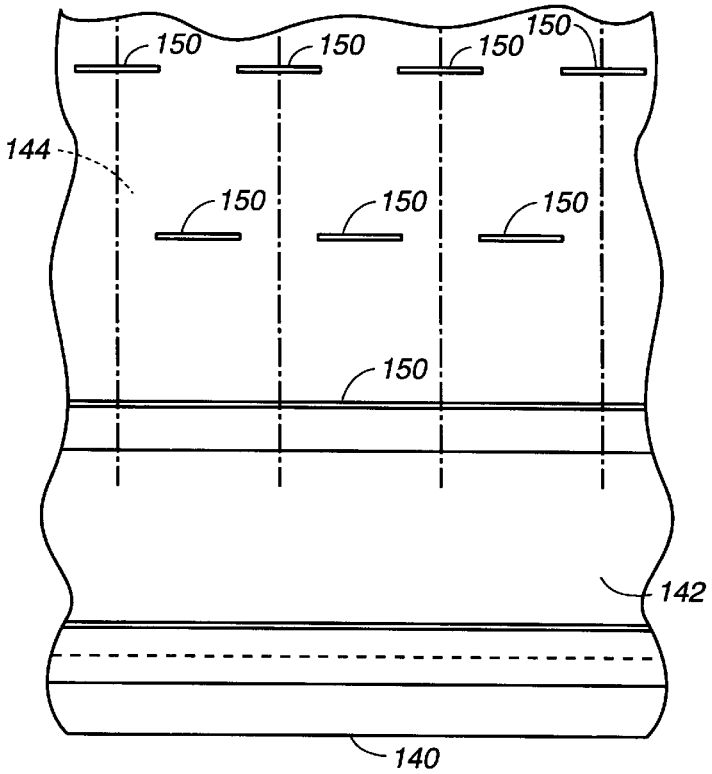
FIG. 7 is a diagrammatic enlarged view depicting a portion of the apparatus as designated by line 7—7 in FIG. 3.

As shown in FIG. 6, the burners preferably incorporate structure which will propagate flame one to the other. More particularly, tubes 198 communicating with the interiors of the burners project from opposed sides thereof to pass the flame along to adjoining tubes of adjoining burners. Preferably, such tubes are spaced along the length of the burners. A single igniter (not shown) within each heating chamber portion can ignite all burners therein.

In summary, rotatable fan member 42 and the associated scroll 46 set up a continuous, recycled flow of air through the system including the through air dryer roll and web supported thereby. More particularly, the rotating fan causes flow of air through a web on the through air dryer roll, through the openings of the through air dryer roll wall into the through air dryer roll interior, through the end of the roll accommodating the fan member and into the housing interior external of the roll fan for recirculation of the air back into the through air dryer roll interior through the web and through the openings in the through air dryer roll wall. The gas heaters and related structure described in detail above heat the recirculated air and are employed to control the web moisture profile.

I claim:

1. Apparatus for drying a web and modifying the moisture profile of the web, said apparatus comprising in combination:

a housing defining a housing interior;

a through air dryer roll mounted for rotational movement relative to said housing for supporting a web while the web is being dried and moving in a machine direction, said through air dryer roll having a double-ended cylindrical through air dryer roll wall defining openings and further defining a through air dryer roll interior communicating with the housing interior through said openings;

a rotatable fan member having fan blades located within said through air dryer roll interior accommodated by an end of said through air dryer roll;

fan member rotating means for rotating said fan member relative to said through air dryer roll within said through air dryer roll interior during rotation of said through air dryer roll;

air flow passageway defining means defining an air flow passageway between said fan member and the exterior of said through air dryer roll, said fan member upon rotation thereof by said fan member rotating means causing flow of air through a web on the through air dryer roll, through the openings of said through air dryer roll wall into the through air dryer roll interior, through the end of said through air dryer roll accommodating said fan member and into said housing interior externally of the roll for recirculation of the air back into said through air dryer roll interior through the web and through the openings of said through air dryer roll wall; and heater means disposed in said housing interior for heating the recirculating air within the housing interior prior to passage thereof through the web and through the openings of the through air dryer roll into the through air dryer roll interior.

2. The apparatus according to claim 1 wherein said heater means comprises a plurality of heaters located within the housing interior.

3. The apparatus according to claim 2 wherein said heaters comprise gas burners disposed alongside one another in the cross-machine direction with each gas burner extending only part way along the length of the cylindrical through air dryer roll wall.

4. The apparatus according to claim 3 additionally comprising air flow separator means located between said gas burners and said cylindrical through air dryer roll wall for dividing air flowing through said housing interior between said gas burners and said cylindrical through air dryer roll wall into separate air flow portions, each of said air flow portions being directed toward an incremental width portion of the web supported by said through air dryer roll.

5. The apparatus according to claim 4 wherein said air flow separator means comprises a plurality of spaced partitions defining a plurality of heated air flow channels, each of said heated air flow channels located adjacent to a gas burner for receiving air heated thereby.

6. The apparatus according to claim 4 additionally comprising mixing means for mixing and creating turbulence in each of said air flow portions prior to engagement thereof with the web supported by said through air dryer roll.

7. The apparatus according to claim 6 wherein said mixing means includes a plurality of mixing elements impacted by said air flow portions.

8. The apparatus according to claim 7 wherein said mixing elements comprise a plurality of mixing bars located between said gas burners and said through air dryer roll means.

9. The apparatus according to claim 3 additionally comprising control means for independently controlling said gas burners to vary the heat applied to air flowing past said gas burners toward said through air dryer roll.

10. The apparatus according to claim 9 additionally comprising air flow separator means defining a plurality of air flow channels, each of said channels for receiving air heated by one of said gas burners and directing same toward an incremental width portion of the web supported by said through air dryer roll.

11. The apparatus according to claim 3 wherein said gas burners comprise a plurality of elongated nozzles extending in the machine direction.

12. The apparatus according to claim 1 wherein said fan member and said through air dryer roll are co-axially rotatably mounted.

13. The apparatus according to claim 1 additionally comprising a partition positioned within said through air dryer roll interior adjacent to said fan member dividing said through air dryer roll interior into first and second interior sections, said fan member being positioned in said first interior section and said partition defining a partition opening allowing movement of flowing air from said second interior section into said first interior section upon rotation of said fan member by said fan member rotating means.

14. The apparatus according to claim 13 wherein said partition includes a fan inlet bell defining said partition opening, said fan inlet bell including a distal inlet bell end closely adjacent to said fan member.

15. The apparatus according to claim 13 wherein said partition has a circular outer periphery terminating closely adjacent to said through air dryer roll wall.

16. The apparatus according to claim 15 wherein said partition is fixedly positioned within the through air dryer roll interior and immobile.

17. The apparatus according to claim 16 additionally comprising seal means between said partition and said through air dryer roll.

18. The apparatus according to claim 16 additionally comprising a cylindrically-shaped air distribution plate extending from said partition into the second interior section of said through air dryer roll, said air distribution plate being immobile and spaced inwardly of said cylindrical through air dryer roll wall, said air distribution plate having a first segment defining a plurality of openings and a second segment having no openings formed therein, and spaced seal elements at the juncture of said first and second segments extending from said air distribution plate into sealing engagement with said cylindrical through air dryer roll wall.

19. The apparatus according to claim 1 wherein said fan member is an centrifugal fan wheel.

20. The apparatus according to claim 19 wherein said air flow passageway defining means includes a fan scroll leading from said centrifugal fan wheel.

* * * * *